United States Patent [19]

Feeley et al.

[11] 4,317,515

[45] Mar. 2, 1982

[54] GAME PACKAGE

[76] Inventors: Ruth E. Feeley; John M. Feeley, both of 19333 Plummer St., Northridge, Calif. 91324

[21] Appl. No.: 177,479

[22] Filed: Aug. 12, 1980

[51] Int. Cl.[3] ..... A63F 3/00; B65D 85/54

[52] U.S. Cl. ..... 206/315 R; 206/499; 206/579; 273/286; 273/294

[58] Field of Search ..... 273/286, 294; 206/315 R, 579, 499; 220/380

[56] References Cited

U.S. PATENT DOCUMENTS

| | | | |
|---|---|---|---|
| 724,760 | 4/1903 | Van Altena | 273/286 |
| 4,252,324 | 2/1981 | Simons | 273/290 X |

FOREIGN PATENT DOCUMENTS

| | | | |
|---|---|---|---|
| 2610112 | 9/1977 | Fed. Rep. of Germany | 273/286 |
| 1501915 | 10/1967 | France | 273/286 |

*Primary Examiner*—Anton O. Oechsle
*Attorney, Agent, or Firm*—Cesari & McKenna

[57] ABSTRACT

A game package or kit includes a number of game pieces having a characteristic shape. These pieces are all contained within a tubular carton whose cross-section corresponds to the shape of the game pieces. The carton includes top and bottom covers which can be engaged over the ends of the carton body to protectively enclose the carton contents. The game pieces and covers can be dimensioned relative to the carton body so that the game pieces can be stacked on the upper end of the carton body with the top cover engaging over the game pieces. The interior of the carton body can then be used to house a flexible game board, instructions and other game pieces. Also the covers are dimensioned to interfit so that they can provide a separate smaller game piece container.

18 Claims, 4 Drawing Figures

GAME PACKAGE

This invention relates to a game package or kit. It relates more particularly to a packaged set of game playing pieces and parts.

BACKGROUND OF THE INVENTION

When merchandising a game, it is desirable that the package containing the components of the game protectively enclose those components during shipping and handling and while the game is being displayed at the point of sale. In addition, however, it is desirable that the purchaser of the game be able to use the same carton in order to store the various game pieces in an orderly and safe manner so that they do not become damaged or lost.

Usually, the components of a game are simply placed in an ordinary rectangular box. Sometimes provision is made for isolating the different pieces and maintaining them in selected orientations by compartmentalizing the box using cardboard dividers. However, in time, the dividers tear and become separated from the box so that they no longer perform their isolating function.

The game with which we are concerned particularly here employs diamond-shaped game pieces in the form of cards and blocks. The cards may be marked with pips or spots like dominos indicating their values or they may be numbered or alphabetized with suits and in some instances the cards or blocks are used in conjunction with a diamond-shaped game board. Due to their diamond shapes, all of these components occupy a relatively large amount of space unless they are properly oriented and stacked.

SUMMARY OF THE INVENTION

Accordingly, it is an object of the present invention to provide an improved game package.

Another object is to provide an improved package for both flexible and rigid game parts.

Another object is to provide a package of this type which is particularly suited to accommodating diamond-shaped game parts.

Another object of the invention is to provide a package which safely encloses game pieces, a game board and instructions during shipping and handling and also provides a permanent holder for the game pieces.

A further object is to provide such a package which helps to market the game itself.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

In general, the present package includes diamond-shaped playing pieces in the nature of numbered and/or alphabetized cards with or without suits and diamond-shaped blocks with pips or spots in the nature of dominos. Usually, but not necessarily, the various game pieces are intended to be used in conjunction with a diamond-shaped game board which is flexible and delineated to define an array of diamond-shaped grid areas of approximately the same size and shape as the cards and blocks. The rules for playing the game or games contained in the package are written out in a small information and instruction book which, when closed, is also in the shape of a diamond.

The game pieces, board and instruction booklet are all contained or packaged in a carton body having the shape of a parallelepiped whose cross-section has the same general diamond shape and more or less the same dimensions as the game cards and blocks. The carton has removable top and bottom covers which engage over opposite ends of the parallelepiped to form a protective enclosure for the components of the game.

In packaging these components, the game board, being flexible, can be rolled up and stuffed into the carton alongside the diamond-shaped instruction booklet. Then the cards and/or blocks can be aligned and stacked in the carton, their orientations being preserved by the matching internal cross-sectional shape of the carton. When the carton covers are in place, the contents of the carton are completely protected during shipping and handling to the point of sale.

In the preferred embodiment of the invention, in order to isolate and preserve the proper orientation of the cards so they can be retrieved easily from the carton, the outside cross-sectional dimensions of the carton are made equal to the corresponding outer dimensions of the cards themselves. Thus instead of fitting within the carton body, the cards sit or rest on the upper edges of the carton body. Further, the carton top cover is made appreciably deeper than the bottom cover. More particularly, its internal depth equals or exceeds the height of the stack of cards comprising the game.

In this preferred embodiment, then, the cards are stacked inside the carton top cover and the cover thereupon placed over the upper end of the carton body so that the cards are captured between the cover and the upper edges of the carton body side walls. It is desirable also that the shallower carton bottom cover have a larger perimeter or cross-sectional area than the top cover. This enables the top cover containing the cards to be removed from the carton body, inverted, and used as a small holder for those cards, with the removed bottom cover then functioning as a separate closure for that holder. In that event, the carton body is also provided with a bottom wall to retain the game parts stored in the carton body.

Thus the carton covers function not only to cover the opposite ends of the overall carton containing all of the game pieces, game board and instruction booklet, but they function also as a separate smaller container or holder for the cards themselves. Accordingly, all of the components of the present game kit are fully protected during their transport to the point of sale. At the same time the components of the game carton itself can be used to properly segregate and orient the game pieces so that they are in the right disposition when it is time to play the game. Accordingly, the package should find wide acceptance in the marketplace.

BRIEF DESCRIPTION OF THE DRAWING

For a fuller understanding of the nature and objects of the invention, reference should be had to the following detailed description, taken in connection with the accompanying drawing, in which.

DESCRIPTION OF THE PREFERRED EMBODIMENT

Figure 1:
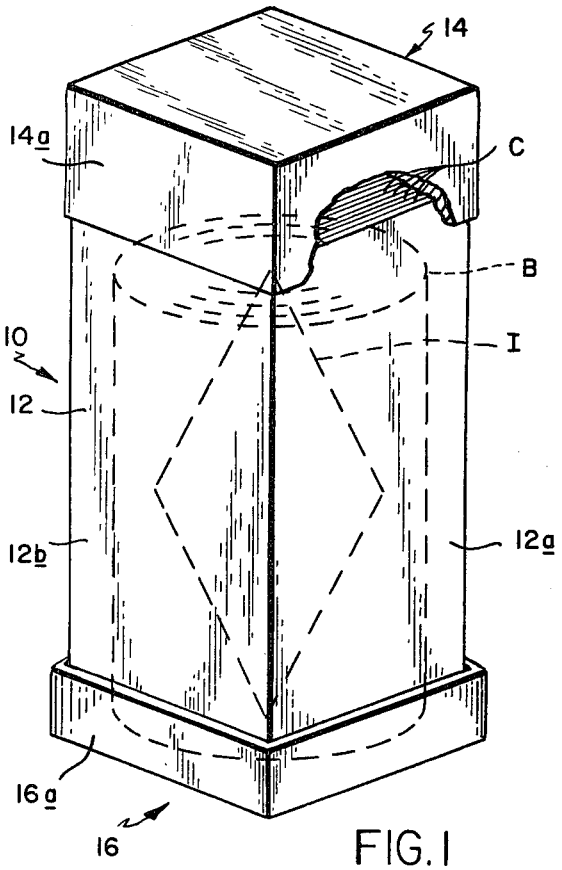
FIG. 1 is a perspective view with parts cut away of a game package embodying the principles of this invention.
Figure 2:
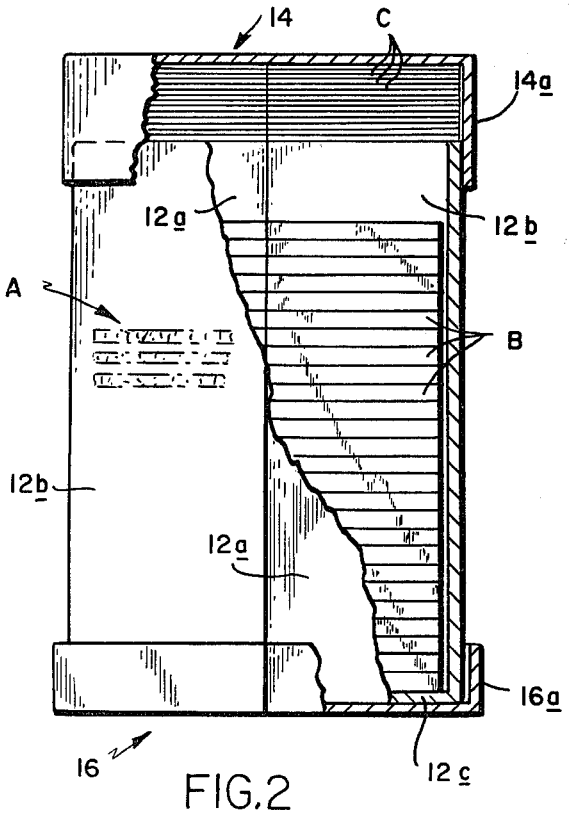
FIG. 2 is an elevational view on a larger scale with parts cut away showing a similar game package.

Referring to FIG. 1 of the drawing, my game package or kit indicated generally at 10 comprises a cardboard carton body 12 having a first pair of spaced-apart parallel side walls 12*a* and a second pair spaced-apart parallel side walls 12*b* all interconnected to form a parallelepiped having a diamond-shaped cross-section. In some cases, the carton body may also have a diamond-shaped bottom wall 12*c* (FIG. 2).

Figure 4:
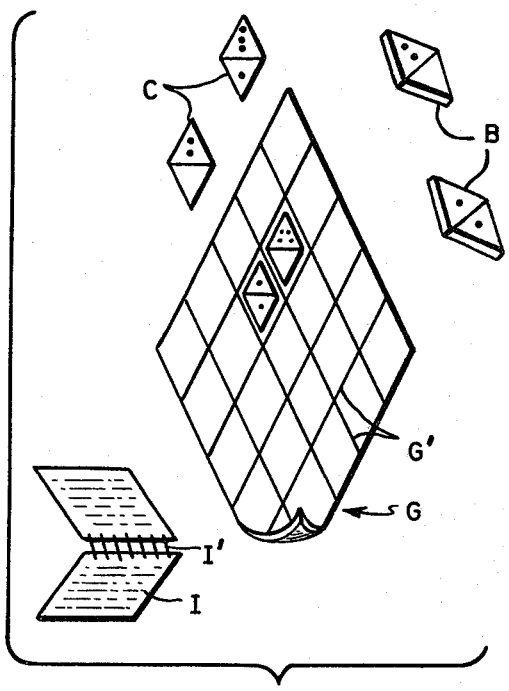
FIG. 4 is a top plan view on a much smaller scale showing the internal elements of the game package in greater detail.

The various components of the game are contained within the carton. Referring particularly to FIGS. 1 and 4, these components may include a set of diamond-shaped cards C. The cards may contain the same indicia as playing cards, i.e. alpha-numerics with suits, or they may be marked with spots much like dominos. In any event, the cards are thin flexible resilient pieces made of plastic or cardboard.

Also included in the game package are diamond-shaped blocks B of wood or plastic which are marked with spots in the manner of conventional dominos. Normally, these cards and blocks are arranged to be manipulated on a game board indicated at G which is cross-hatched with lines G′ so as to define an array of diamond-shaped areas whose dimensions are comparable to those of the cards and blocks. Preferably, the game board G is made of a flexible material which does not wrinkle so that the game board can be rolled up and stored in the carton body 12 as shown in FIG. 1. To this end, the game board 6 may be made of a thin piece of plastic foam material.

Instructions for playing the game or games are contained in an instruction booklet I whose pages are hinged at I′ with a spiral binder, staples or other such securement. The booklet I instructs people how to manipulate the game pieces on the board G. Booklet I, when closed, is diamond-shaped to correspond to the shape of the other game parts for aesthetic and marketing reasons and can also be stored in the same container 12.

Preferably, to prevent the cards C from falling down inside the carton and becoming disorganized, the dimensions of the cards are made to correspond with the outer dimensions of the carton body 12 cross-section. In other words, the side edges of the cards are arranged to correspond with the mating side edges of the carton body cross-section with the result that the cards can be stacked in register on top of the carton body as shown in FIG. 1.

Still referring to FIG. 1, the package also includes a relatively deep, diamond-shaped cover 14 which is arranged to engage over the top of carton body 12 including the stack of cards C thereon. The cover has side walls 14*a* which surround the cards and extend around the perimeter of the carton body as shown in those figures. In other words, the depth of the cover 14 is sufficient to accommodate the stack of cards C and also enable its side walls 14*a* to overlap the upper edge margins of the carton body.

Finally, the package has a diamond-shaped bottom cover 16 with side walls 16*a*. The bottom cover is similar to cover 14 except that it is slightly larger in area, but not as deep for reasons to be discussed presently. If the carton body 12 does not include a bottom wall 12*c*, the cover 16 closes the bottom of the carton. If it does as in FIG. 2, cover 16 engages under and reinforces that bottom wall.

If the game package does not include the blocks B, the flexible game board G and the instruction booklet I are positioned in the carton as shown in FIG. 1 with the cards C preferably being stacked on top and maintained there by the cover 14. In the event that the game or games in the package require blocks B, the blocks can be stacked inside the carton as shown in FIG. 2, with the cards reposing at the top of the carton and protectively enclosed by the cover 14. In that event, the outside of the carton 12 may be printed with advertising or game playing instructions as indicated at A in FIG. 2. Alternatively, the written instructions, flexible board and cards C may be placed in the carton void above blocks B, the cards being dimensioned accordingly to fit within the carton body.

Figure 3:
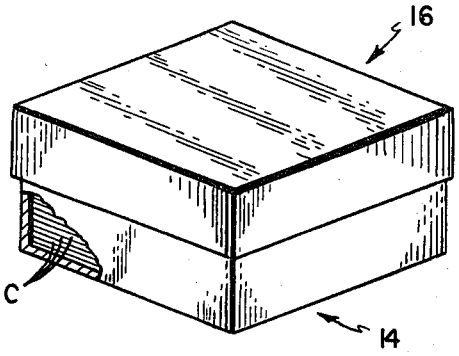
FIG. 3 is a perspective view on the scale of FIG. 1 illustrating the operation of certain components of the package.

Referring now to FIGS. 2 and 3, the present package provides a separate holder for the cards C in the event that the user desires to keep them organized in a convenient location on a table or elsewhere without their being too conspicuous. For this, the carton bottom cover 16 is made slightly larger in area than the deeper top cover 14 so that when the two covers are removed from the carton, the inverted cover 14 can function as a holder for the cards C, with the cover 16 serving as a closure for that holder as illustrated in FIG. 3. The carton body 12 and its two covers 14 and 16 thus perform a dual function, namely, as a secure shipping container for all of the components of the game up to the point of sale of the package and as an organizing holder for the cards and a separate repository for the remaining game parts. In addition to those utilitarian functions, the package as a whole serves a unique advertising function in emphasizing the diamond motif of the game and of its various interrelated components.

It will thus be seen that the objects set forth above, among those made apparent from the preceding description, are efficiently attained. Also certain changes may be made in the above construction without departing from the scope of the invention. For example, instead of the game pieces and carton having a diamond shape, they can have other mating polygonal shapes such as triangles, octagons, etc. Therefore, it is intended that all matter contained in the above description or shown in the accompanying drawing be interpreted as illustrative and not in a limiting sense.

It is also to be understood that the following claims are intended to cover all of the generic and specific features of the invention herein described.

What is claimed as new and desired to be secured by Letters Patent of the United States is:

1. A game package comprising

A. an elongated tubular carton body having a selected cross-sectional shape;

B. a plurality of game pieces having substantially the same shape and dimensions as said carton body cross-section so that said game pieces can be stacked in register with one end of the carton body;

C. a first cover having approximately the same shape and dimensions as the carton body cross-section at said one end, said first cover having side walls extending around the perimeter of the cover, the height of the side walls being appreciably greater than the height of the stack of game pieces in register with the carton body end so that the first cover can be engaged over the game pieces and said one carton end to protectively enclose the game pieces; and D. a second cover having approximately the same shape and dimensions as the carton body cross-section at said other carton end, said second cover having side walls which are dimensioned to engage around the other end of the carton body.

2. The game package defined in claim 1 wherein the perimeter of the second cover is slightly greater than that of the first cover so that when the covers are removed from the carton body, the first cover can be inverted to provide a separate holder for said game pieces with the second cover providing a closure for that holder.

3. The game package defined in claim 2 wherein the height of the second cover side walls is less than the height of the first cover side walls.

4. The game package defined in claim 1 and further including a game board positioned within the carton body, said game board bearing indicia for controlling the play of the game pieces.

5. The game package defined in claim 4 wherein the game board is flexible so that it can be rolled up inside the carton body.

6. The game package defined in claim 5 wherein the game board comprises a thin piece of plastic foam material.

7. The game package defined in claim 5 wherein the shape of the game board is similar to that of the game pieces and the carton body cross-section.

8. The game package defined in claim 1 and further including a second plurality of game pieces different from the first, said different pieces having the same shape and dimensions as the interior cross-section of the carton body so that the different game pieces can be stacked in register inside the carton body.

9. The game package defined in claim 8 and further including an instruction booklet which, when closed, has the same shape as the game pieces, said booklet being dimensioned to fit inside the carton body.

10. The game package defined in claim 9 wherein the carton body cross-section, covers and game pieces are all diamond-shaped.

11. A game package comprising

A. a tubular container having a selected cross-sectional shape;

B. a first cover having a shape similar to that of the container cross-section, and having peripheral side walls which can overlap the walls of the container when the first cover is engaged over one end of the container;

C. a second cover, said second cover having a shape similar to that of the container cross-section and having peripheral side walls which can overlap the walls of the container when the second cover is engaged over the opposite end of the container;

D. the first cover having side walls which enclose a greater area than the corresponding side walls of the second cover so that when the two covers are removed from the container, the first cover can be used as a closure for the second cover; and E. a plurality of geometrically similar game pieces whose corresponding dimensions are substantially the same so that the game pieces can be stacked in register within said covers, the game pieces having substantially the same dimensions as the external cross-section of the container so that when the game pieces are stacked in one of said covers, that one cover can be engaged over one end of the container with the game pieces being trapped between the one cover and the one end of the container.

12. The game package defined in claim 11 wherein the side walls of the second cover are higher than the side walls of the first cover.

13. The game package defined in claim 11 and further including a flexible game board positioned inside the container.

14. The game package defined in claim 13 and further including an instruction booklet positioned in the container.

15. The game package defined in claim 13 and further including a second set of similar game pieces dimensioned to stack in register inside the container.

16. The game package defined in claim 15 wherein the container cross-section covers, game pieces, game board and booklet are all diamond-shaped.

17. A game package comprising

A. an elongated tubular carton body having a selected cross-sectional shape, a closed end and an open end;

B. a plurality of game pieces having substantially the same shape and dimensions as said carton body cross-section so that said game pieces can be stacked in register with the open end of the carton body; and C. a removable cover having approximately the same shape and dimensions as the carton body cross-section at said open end, said cover having side walls extending around the perimeter of the cover, the height of the side walls being appreciably greater than the height of the stack of game pieces in register with the carton body open end so that the cover can be engaged over the game pieces and the carton body open end to protectively enclose the game pieces and the carton body.

18. The game package defined in claim 17 wherein the carton body cross-section, cover and game pieces are all diamond-shaped.

* * * * *